US005903944A

United States Patent [19]

Burrell

[11] Patent Number: 5,903,944

[45] Date of Patent: May 18, 1999

[54] BABY BOTTLE CLEANER

[76] Inventor: Frank Burrell, 35 Jendale Ct., Jenning, Mo. 63136

[21] Appl. No.: 08/891,399

[22] Filed: Jul. 10, 1997

[51] Int. Cl.[6] ..... A46B 13/04

[52] U.S. Cl. ..... 15/65; 15/59; 134/171; 134/167 R

[58] Field of Search ..... 15/59, 65, 66, 15/67, 68, 69; 134/167 R, 168 R, 171; 422/303

[56] References Cited

U.S. PATENT DOCUMENTS

| | | | |
|---|---|---|---|
| 957,301 | 5/1910 | Buchheit | 15/67 |
| 1,975,392 | 10/1934 | Fera | 15/69 |
| 2,029,844 | 2/1936 | Tyler | 134/171 |
| 4,115,891 | 9/1978 | Wills | 15/71 |
| 5,265,628 | 11/1993 | Sage et al. | 134/58 R |
| 5,419,348 | 5/1995 | Kuta | 134/58 R |
| 5,425,385 | 6/1995 | Kuta et al. | 134/48 |
| 5,435,063 | 7/1995 | Hedrick et al. | 15/59 |
| 5,507,060 | 4/1996 | Quimpo | 134/171 |

FOREIGN PATENT DOCUMENTS

| | | | |
|---|---|---|---|
| 2 134 788 | 8/1984 | United Kingdom | 422/303 |

*Primary Examiner*—Robert Warden
*Assistant Examiner*—Theresa T. Snider

[57] ABSTRACT

A baby bottle cleaner is provided including a base and a plurality of bottle cleaning assemblies situated on the base and adapted to emit water therefrom. Such assemblies are adapted to accept the baby bottle thereon for cleaning purposes. Further provided is a nipple cleaning cover adapted to be removably coupled to the base such that the nipple cleaning cover encompasses the bottle cleaning assemblies. The nipple cleaning cover further includes a mesh basket positioned in the cover for supporting a plurality of nipples therein such that the nipples are cleaned.

4 Claims, 5 Drawing Sheets

BABY BOTTLE CLEANER

BACKGROUND OF THE INVENTION

1. Field of the Invention

The present invention relates to bottle cleaners and more particularly pertains to a new baby bottle cleaner for cleaning both baby bottles and the nipples thereof.

2. Description of the Prior Art

The use of bottle cleaners is known in the prior art. More specifically, bottle cleaners heretofore devised and utilized are known to consist basically of familiar, expected and obvious structural configurations, notwithstanding the myriad of designs encompassed by the crowded prior art which have been developed for the fulfillment of countless objectives and requirements.

Known prior art bottle cleaners include U.S. Pat. No. 5,419,348; U.S. Pat. No. 5,435,036; U.S. Pat. Des. No. 271,532; U.S. Pat. No. 5,425,385; U.S. Pat. No. 4,115,891; and U.S. Pat. No. 5,265,628.

In these respects, the baby bottle cleaner according to the present invention substantially departs from the conventional concepts and designs of the prior art, and in so doing provides an apparatus primarily developed for the purpose of cleaning both baby bottles and the nipples thereof.

SUMMARY OF THE INVENTION

In view of the foregoing disadvantages inherent in the known types of bottle cleaners now present in the prior art, the present invention provides a new baby bottle cleaner construction wherein the same can be utilized for cleaning both baby bottles and the nipples thereof.

The general purpose of the present invention, which will be described subsequently in greater detail, is to provide a new baby bottle cleaner apparatus and method which has many of the advantages of the bottle cleaners mentioned heretofore and many novel features that result in a new baby bottle cleaner which is not anticipated, rendered obvious, suggested, or even implied by any of the prior art bottle cleaners, either alone or in any combination thereof.

To attain this, the present invention generally comprises a base having a circular top face, a circular bottom face, and a periphery formed therebetween defining an interior space. As shown in FIGS. 2 & 4, the base includes a plurality of pads situated on the bottom face thereof for precluding movement on a supporting surface. Further included is a plurality of bottle brush assemblies situated on diametrically opposite portions of the top face of the base. As can best be seen in FIGS. 4 & 5, each bottle brush assembly comprises a circular external mount with an aperture formed therein and an annular flange extending radially outward from an upper peripheral edge thereof. An annular retainer is rotatably coupled to the flange of the exterior mount. Such retainer has an upper inner periphery with a plurality of threaded grooves formed therein. Note FIG. 5. Also included is an internal mount situated within the interior space of the base, as shown in FIG. 4. Such internal mount is coupled to the bottom surface of the base and has an L-shaped conduit formed therein. The L-shaped conduit is equipped with a vertical upper portion and horizontal lower portion. A rotating post assembly is provided with a lower portion rotatably coupled within the interior space of the base between the top face thereof and the internal mount. As shown in FIG. 5, an upper portion is coupled to the lower portion and extends upwardly through the aperture of the exterior mount. The rotating post assembly includes an axial bore formed therein which resides in communion with the vertical upper portion of the L-shaped conduit of the internal mount. The upper portion of rotating post assembly of each bottle brush assembly further has a plurality of radially extending nylon bristles serpentinely situated along an entire height of upper portion. By this structure, the rotating post assemblies and components fixedly coupled thereto are adapted to rotate about a vertical axis. The present invention thus allows use of a plurality of baby bottles therewith. When inverted, each of such bottles is equipped with a top closed end and an open bottom end with a plurality of threaded grooves formed therein. Such threaded grooves are adapted for allowing releasable coupling with the retainer of an associated one of the bottle brush assemblies such that a bottle may be positioned about the upper portion of one of the rotating post for being cleaned. For effecting the rotation of the rotating post assemblies, a drive mechanism is included. Note FIG. 4. Such drive mechanism includes central gear means rotatably coupled within the interior space of the base between the top face and the bottom face at a central extent thereof. The central gear means has a top extent with smooth cylindrical configuration and a bottom extent with a bevel gear. Further provided are a plurality of bands situated about the lower portion of each rotating post assembly and the top extent of the central gear means. A motor is positioned within the interior space of the base with a horizontally oriented rotor having a bevel gear coupled thereto. Such bevel gear is adapted for engaging the bevel gear of the central gear means thereby effecting the rotation of the rotating post assemblies of each of the bottle brush assemblies. As such, upon the receipt of power, the motor serves to allow the scrubbing of an interior surface of each bottle. With reference in particular to FIGS. 4 & 7, it can be seen that a primary water conduit is included. Such water conduit has an inlet situated on the periphery of the base for receiving pressurized water therefrom. Further, the primary water conduit has an outlet interconnected with the horizontal extent of the L-shaped conduit of each internal mount. Such interconnection is accomplished by way of a plurality of secondary water conduits. In use, the primary and secondary water conduits serve to allow the dispersing of water from a top opening of each rotating post assembly of the bottle brush assemblies. This in turn facilitates the cleaning of the bottles. As shown in FIG. 7, a plurality of valves are each coupled to an associated one of the interconnections between the outlet of the primary water conduit and the secondary water conduit of the corresponding internal mount of one of the bottle brush assemblies. Each valve is adapted to open only upon the receipt of an activation signal. For allowing the cleaning of nipples associated with the baby bottles, a nipple cleaning cover is provided. As shown in FIG. 9, the nipple cleaning cover has a cylindrical configuration with a top opening having a plurality of threaded grooves formed in an inner periphery thereof. A bottom opening of the nipple cleaning cover is also equipped with a plurality of threaded grooves. Such grooves, however, are formed in an outer periphery of the cover and are adapted for engaging the top face of the base. When such engagement is effected during use, the nipple cleaning cover encompasses the bottle brush assemblies. With reference still to FIG. 9, it can be seen that the nipple cleaning cover further includes a mesh basket situated on the top opening of the cover. The basket is further shown to depend downwardly within the cover for supporting a plurality of nipples therein. Lastly, a cap is adapted to be screwably coupled over the top opening of the cover thereby affording a seal. By this structure, upon the dispensing of water from one of the rotating post assemblies without an associated bottle, the nipples are thereby cleaned. Finally, control buttons are provided for allowing the selective transmission of power to the motor and the transmission of the activation signal to the different valves.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature an essence of the technical disclosure of the application. The abstract is neither intended to define the invention of the application, which is measured by the claims, nor is it intended to be limiting as to the scope of the invention in any way.

It is therefore an object of the present invention to provide a new baby bottle cleaner apparatus and method which has many of the advantages of the bottle cleaners mentioned heretofore and many novel features that result in a new baby bottle cleaner which is not anticipated, rendered obvious, suggested, or even implied by any of the prior art bottle cleaners, either alone or in any combination thereof.

It is another object of the present invention to provide a new baby bottle cleaner which may be easily and efficiently manufactured and marketed.

It is a further object of the present invention to provide a new baby bottle cleaner which is of a durable and reliable construction.

An even further object of the present invention is to provide a new baby bottle cleaner which is susceptible of a low cost of manufacture with regard to both materials and labor, and which accordingly is then susceptible of low prices of sale to the consuming public, thereby making such baby bottle cleaner economically available to the buying public.

Still yet another object of the present invention is to provide a new baby bottle cleaner which provides in the apparatuses and methods of the prior art some of the advantages thereof, while simultaneously overcoming some of the disadvantages normally associated therewith.

Still another object of the present invention is to provide a new baby bottle cleaner for cleaning both baby bottles and the nipples thereof.

Yet another object of the present invention is to provide a new baby bottle cleaner which includes a base and a plurality of bottle cleaning assemblies situated on the base and adapted to emit water therefrom. Such assemblies are adapted to accept the baby bottle thereon for cleaning purposes. Further provided is a nipple cleaning cover adapted to be removably coupled to the base such that the nipple cleaning cover encompasses the bottle cleaning assemblies. The nipple cleaning cover further includes a mesh basket positioned in the cover for supporting a plurality of nipples therein such that the nipples are cleaned.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
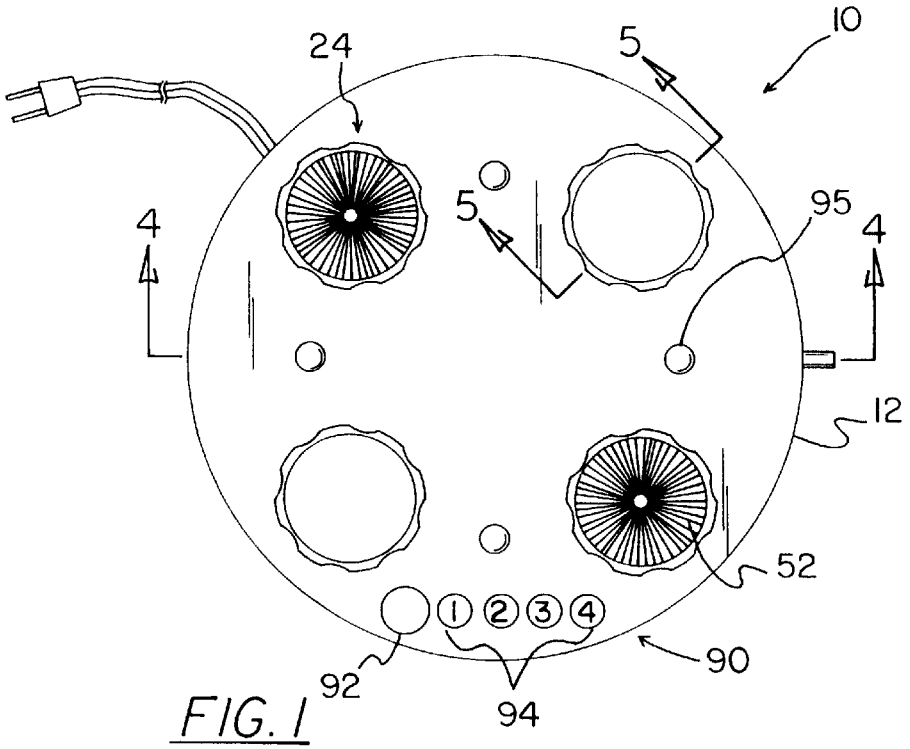
FIG. 1 is a top view of the present invention.

With reference now to the drawings, a new baby bottle cleaner embodying the principles and concepts of the present invention and generally designated by the reference numeral 10 will be described.

Figure 2:
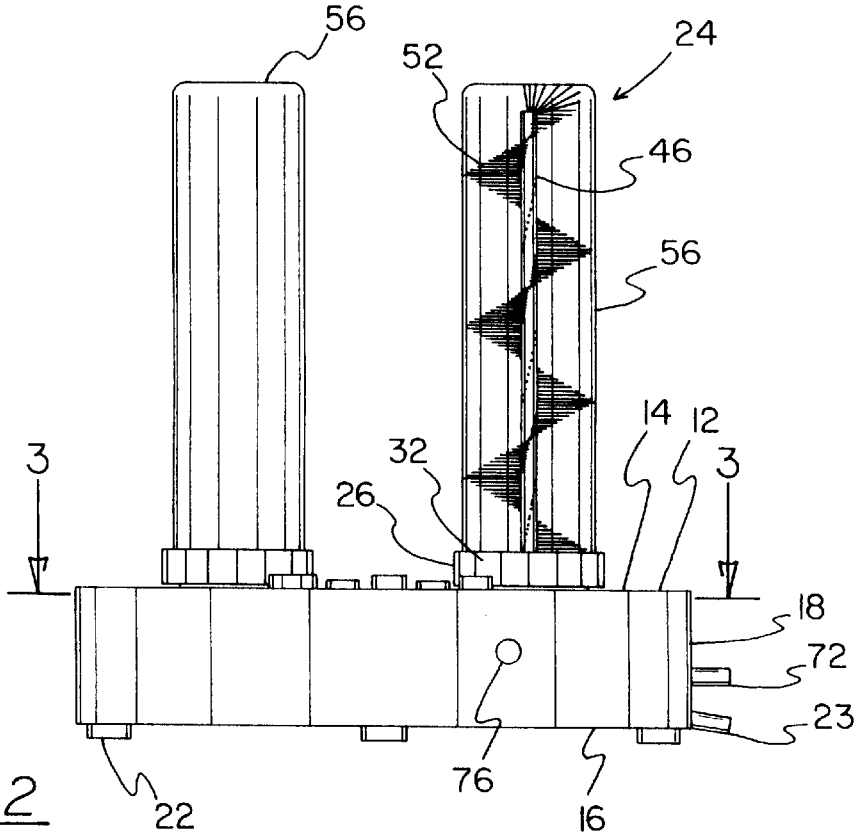
FIG. 2 is a side view of the present invention.
Figure 3:
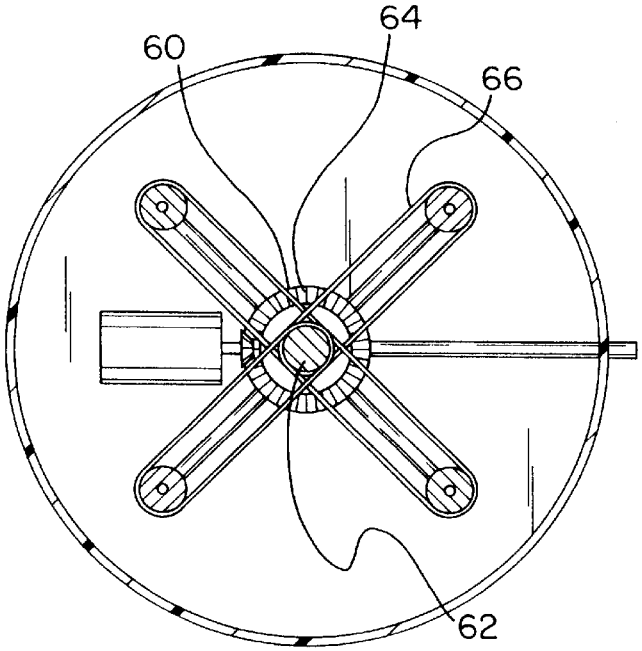
FIG. 3 is a cross-sectional view of the present invention taken along line 3—3 shown in FIG. 2.
Figure 4:
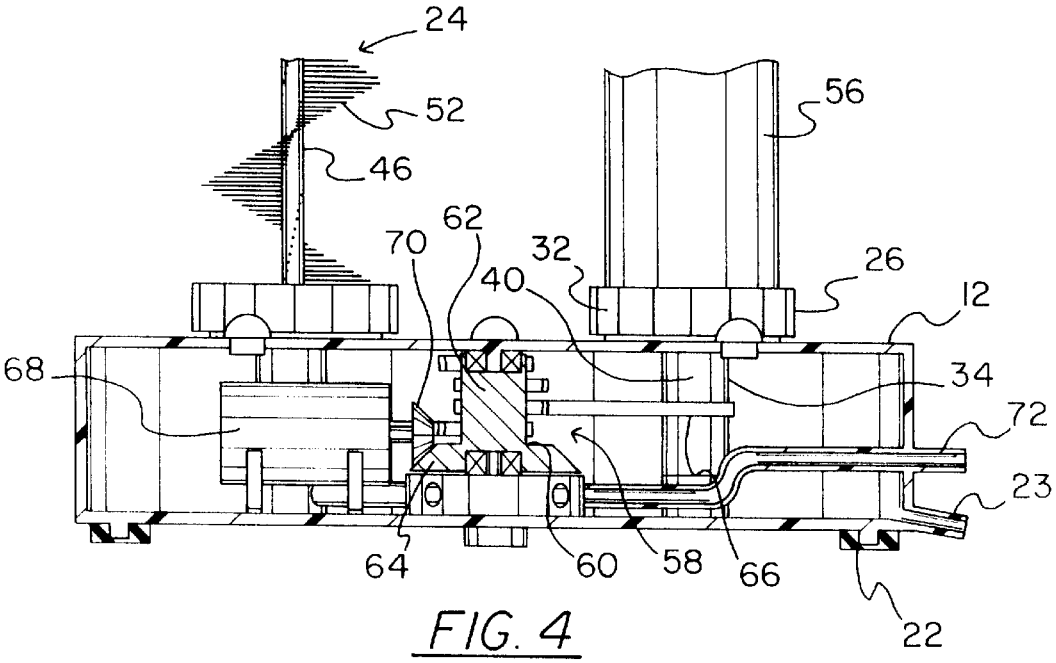
FIG. 4 is a cross-sectional view of the present invention taken along line 4—4 shown in FIG. 1.

Specifically, the system 10 of the present invention includes a base 12 having a circular top face 14, a circular bottom face 16, and a periphery 18 formed therebetween defining an interior space. As shown in FIGS. 2 & 4, the base includes a plurality of pads 22 situated on the bottom face thereof for precluding movement on a supporting surface. For reasons that will become apparent later, the base may be equipped with a drainage aperture 23.

Further included is a plurality of bottle brush assemblies 24 situated on diametrically opposite portions of the top face of the base. In the preferred embodiment, a total of two pairs of diametrically opposed brush assemblies are included. As can best be seen in FIGS. 4 & 5, each bottle brush assembly comprises a circular external mount 26 with an aperture 28 formed therein and an annular flange 30 extending radially outward from an upper peripheral edge thereof. An annular retainer 32 is rotatably coupled to the flange of the exterior mount. Such retainer has an upper inner periphery with a plurality of threaded grooves formed therein. Note FIG. 5.

Figure 5:
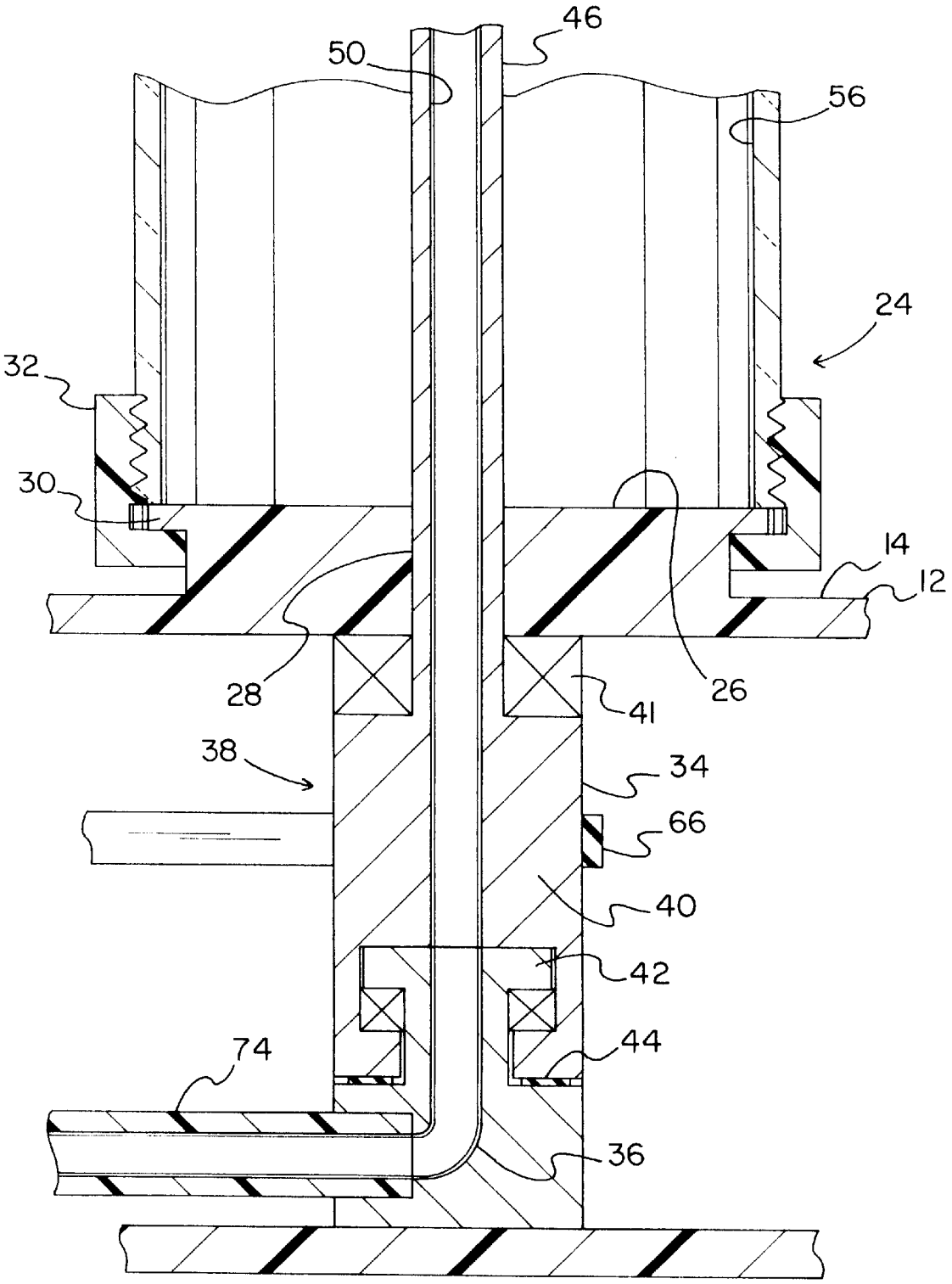
FIG. 5 is a cross-sectional view of the present invention taken along line 5—5 shown in FIG. 1.
Figure 6:
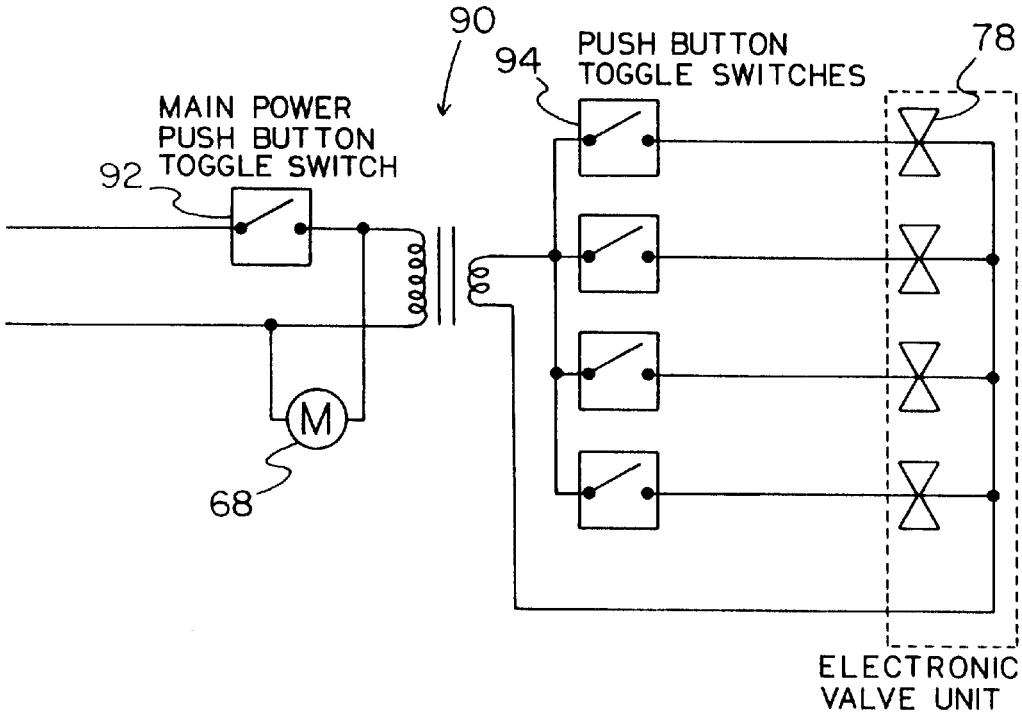
FIG. 6 is a schematic diagram showing the interconnection of various electrical components of the present invention.

Also included is an internal mount 34 situated within the interior space of the base, as shown in FIG. 4. Such internal mount is coupled to the bottom surface of the base and has an L-shaped conduit 36 formed therein. The L-shaped conduit is equipped with a vertical upper portion and a horizontal lower portion. A rotating post assembly 38 is provided with a lower portion 40 rotatably coupled within the interior space of the base between the top face thereof and the internal mount. Such rotatable coupling is facilitated by way of ball bearings 41. To effect a seal between the lower portion of the rotating post assembly and the internal mount, the internal mount and lower portion have annular flanges 42 which are separated by associated bearings. To force the annular flanges toward each other and thereby afford a tight fit, an annular bushing 44 is positioned below one of the flanges for biasing it upwardly. As shown in FIG. 5, an upper portion 46 of each rotating post assembly is coupled to the lower portion and extends upwardly through the aperture of the exterior mount. The upper portion preferably has a height slightly less than that of a conventional baby bottle. The entire rotating post assembly includes a vertically oriented axial bore 50 formed therein which resides in communion with the vertical upper portion of the L-shaped conduit of the internal mount.

The upper portion of rotating post assembly of each bottle brush assembly further has a plurality of radially extending nylon bristles 52 serpentinely situated along an entire height of upper portion. By this structure, the rotating post assemblies and components fixedly coupled thereto are adapted to rotate about a vertical axis.

The present invention thus allows use of a plurality of baby bottles 56 therewith. When inverted, each of such bottles 56 has a top closed end and an open bottom end with a plurality of threaded grooves formed therein. Such threaded grooves are adapted for allowing releasable coupling with the retainer of an associated one of the bottle brush assemblies. Therefore, a bottle may be positioned about the upper portion of one of the rotating post for the purpose of being cleaned.

For effecting the rotation of the rotating post assemblies, a drive mechanism 58 is included. Note FIG. 4. Such drive mechanism includes central gear means 60 rotatably coupled within the interior space of the base between the top face and the bottom face at a central extent thereof. The central gear means has a top extent 62 with smooth cylindrical configuration and a bottom extent 64 with a bevel gear. Further provided are a plurality of bands 66 situated about the lower portion of each rotating post assembly and the top extent of the central gear means. A motor 68 is positioned within the interior space of the base with a horizontally oriented rotor having a bevel gear 70 coupled thereto. Such bevel gear is adapted for engaging the bevel gear of the central gear means thereby effecting the rotation of the rotating post assemblies of each of the bottle brush assemblies. As such, upon the receipt of power, the motor serves to allow the scrubbing of an interior surface of each bottle.

Figure 7:
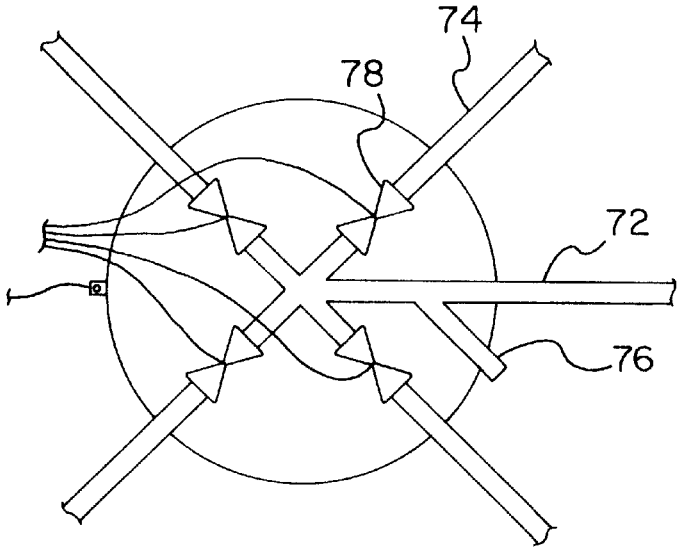
FIG. 7 is a top view of the primary and secondary water conduits of the present invention with the associated valves.
Figure 8:
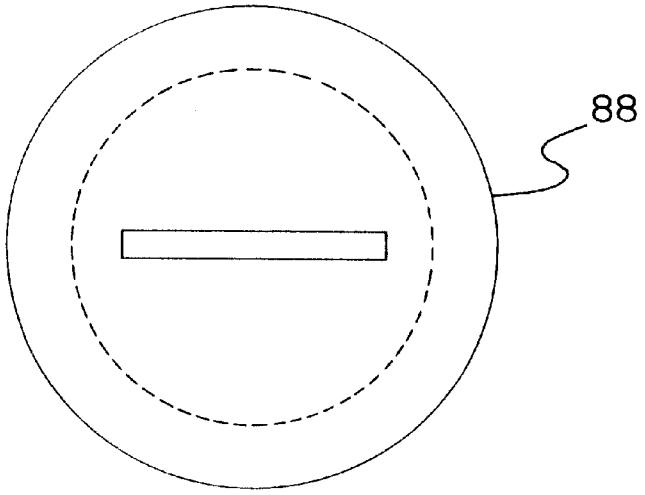
FIG. 8 is a top view of the cap associated with the nipple cleaning cover of the present invention.

With reference in particular to FIGS. 4 & 7, it can be seen that a primary water conduit 72 is included. Such water conduit has an inlet situated on the periphery of the base for receiving pressurized water therefrom. Further, the primary water conduit has an outlet interconnected with the horizontal extent of the L-shaped conduit of each internal mount. Such interconnection is accomplished by way of a plurality of secondary water conduits 74. In use, the primary and secondary water conduits serve to allow the dispersing of water from a top opening of each rotating post assembly of the bottle brush assemblies. This in turn facilitates the cleaning of the bottles. As an option, the primary water conduit may be connected with a detergent conduit 76 which is adapted to accept liquid detergent from a source.

As shown in FIG. 7, a plurality of valves 78 are each coupled to an associated one of the interconnections between the outlet of the primary water conduit and the secondary water conduit of the corresponding internal mount of one of the bottle brush assemblies. Each valve is adapted to open only upon the receipt of an activation signal.

Figure 9:
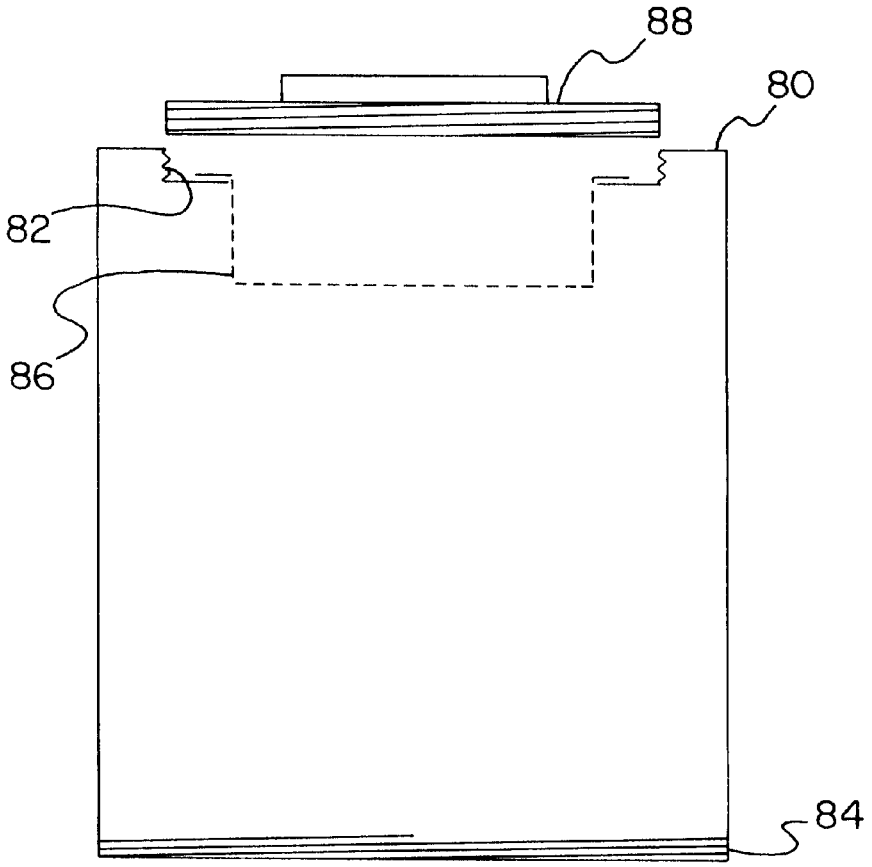
FIG. 9 is a side view of the nipple cleaning cover of the present invention.

For allowing the cleaning of nipples associated with the baby bottles, a clear plastic nipple cleaning cover 80 is provided. As shown in FIG. 9, the nipple cleaning cover has a cylindrical configuration with a top opening having a plurality of threaded grooves 82 formed in an inner periphery thereof. A bottom opening of the nipple cleaning cover is also equipped with a plurality of threaded grooves 84. Such grooves, however, are formed in an outer periphery of the cover and are adapted for engaging unillustrated threaded grooves formed in the top face of the base. When such engagement is effected during use, the nipple cleaning cover encompasses the bottle brush assemblies. With reference still to FIG. 9, it can be seen that the nipple cleaning cover further includes a mesh basket 86 situated on the top opening of the cover. The basket is further shown to depend downwardly within the cover for supporting a plurality of nipples therein. Lastly, a cap 88 is adapted to be screwably coupled over the top opening of the cover thereby affording a seal.

By this structure, upon the dispensing of water from one of the rotating post assemblies without an associated bottle, the nipples are thereby cleaned. Preferably, the basket is removably situated within the nipple cleaning cover. In an alternate embodiment, a plurality of separate vertical water dispensing posts with associated valves may be provided so that all of the rotating post assemblies may be used to clean bottles.

Finally, control buttons 90 are provided for allowing the selective transmission of power to the motor and the transmission of the activation signal to the different valves. Such control buttons include a main power button 92 and a plurality of push button valve toggle switches 94. As an option, each valve toggle switch may be equipped with a light emitting diode 95 for giving prior indication whether water will be dispersed from an associated bottle brush assembly upon the switching of the main power button. When the present invention is powered by a conventional power receptacle, it is preferred that a fuse mechanism be employed for affording protection against electrical shock. Yet another option would be to incorporate a temperature gauge which would allow a user to control the water temperature entering the primary water conduit.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A baby bottle cleaner system comprising, in combination:

a base having a circular top face, a circular bottom face, and a periphery formed therebetween defining an interior space, the base having a plurality of pads situated on the bottom face thereof for precluding movement on a supporting surface, wherein the base has a drainage aperture formed therein and a plurality of threaded grooves formed in the periphery thereof;

a plurality of bottle brush assemblies situated on diametrically opposite portions of the top face of the base, each bottle brush assembly comprising a circular external mount with an aperture formed therein and an annular flange extending radially outward from an upper peripheral edge thereof, an annular retainer rotatably coupled to the flange of the exterior mount and having an upper inner periphery with a plurality of threaded grooves formed therein, an internal mount situated within the interior space of the base and coupled to the bottom surface thereof and having an L-shaped conduit formed therein with a vertical upper portion and horizontal lower portion, and a rotating post assembly with a lower portion rotatably coupled within the interior space of the base between the top face thereof and the internal mount and an upper portion coupled to the lower portion and extending upwardly through the aperture of the exterior mount, the rotating post assembly having an axial bore formed therein being in communion with the vertical upper portion of the L-shaped conduit of the internal mount, the upper portion of rotating post assembly of each bottle brush assembly further having a plurality of radially extending nylon bristles serpentinely situated along an entire height of upper portion, whereby the rotating post assemblies are adapted to rotate;

a plurality of bottles each with a closed end and an open bottom end with a plurality of threaded grooves formed therein for allowing releasable coupling with the retainer of an associated one of the bottle brush assemblies such that a bottle may be fixedly positioned about the upper portion of one of the rotating post assemblies for being cleaned;

a drive mechanism including a central gear means rotatably coupled within the interior space of the base between the top face and the bottom face at a central extent thereof, the central gear means having a top extent with smooth cylindrical configuration and a bottom extent with a bevel gear, the drive mechanism further including a plurality of bands situated about the lower portion of each rotating post assembly and the top extent of the central gear means and a motor positioned within the interior space of the base with a rotor having a bevel gear coupled thereto for engaging the bevel gear of the central gear means thereby effecting the rotation of the rotating post assemblies of each of the bottle brush assemblies upon the receipt of power thereby scrubbing of an interior surface of each bottle;

a water conduit having an inlet situated on the periphery of the base for receiving pressurized water therefrom and an outlet interconnected with the horizontal extent of the L-shaped conduit of each internal mount for allowing the dispersing of water from a top opening of each rotating post assembly of the bottle brush assemblies thus facilitating the cleaning of the bottles, wherein a secondary conduit is connected to the water conduit for introducing a detergent into water flowing through the water conduit;

a plurality of valves each coupled to an associated one of the interconnections between the outlet of the water conduit and the horizontal extent of the L-shaped conduit of the corresponding internal mount of one of the bottle brush assemblies, whereby each valve is adapted to open only upon the receipt of an activation signal;

a nipple cleaning cover including a cylindrical configuration with a top opening having a plurality of threaded grooves formed in an inner periphery thereof and a bottom opening with a plurality of threaded grooves formed in an outer periphery thereof for engaging the threaded grooves of the periphery of the base such that the nipple cleaning cover encompasses all of the bottle brush assemblies, the nipple cleaning cover further including a mesh basket situated on the top opening of the cover and depending downwardly for supporting a plurality of nipples therein and a cap adapted to be screwably coupled over the top opening of the cover thereby affording a seal, whereby upon the dispensing of water from one of the rotating post assemblies without an associated bottle, the nipples are cleaned; and control buttons for allowing the selective transmission of power to the motor and the transmission of the activation signal to the different valves, wherein a light is positioned adjacent to each bottle brush assembly for indicating the actuation of the associated valve via a dedicated switch, wherein a temperature gauge is adapted for determining a temperature of water entering the water conduit.

2. A baby bottle cleaner adapted for use with a plurality of bottles which, when inverted, each have a closed top end and an open bottom end with a plurality of threaded grooves formed therein, the cleaner comprising:

a base having threaded grooves formed about a periphery thereof;

a plurality of bottle cleaning assemblies situated on the base, each bottle cleaning assembly having an annular retainer rotatably coupled to the base;

said annular retainer of each of said bottle cleaning assemblies adapted for allowing releasable coupling with one of the bottles such that the bottle may be positioned about the bottle cleaning assembly for being cleaned;

said bottle cleaning assembly further including a post rotatably coupled to the base and adapted to emit water therefrom, wherein the post has a plurality of bristles formed thereon and is driven by way of a drive mechanism; and a nipple cleaning cover with a top opening having a plurality of threaded grooves formed in an inner periphery thereof and a bottom opening with a plurality of threaded grooves formed in a periphery thereof for engaging the threaded grooves of the base such that the nipple cleaning cover encompasses each of the bottle brush assemblies, the nipple cleaning cover further including a mesh basket situated on the top opening of the cover and depending downwardly for supporting a plurality of nipples therein and a cap adapted to be screwably coupled over the top opening of the cover thereby affording a seal, whereby upon the dispensing of water from one of the rotating post assemblies without an associated bottle thereon, the nipples are cleaned;

wherein a plurality of switches are included each for selectively supplying one of the bottle cleaning assemblies with water;

wherein a plurality of lights are included each positioned adjacent to one of the bottle cleaning assemblies for giving prior indication that water is to be dispensed from the post thereof.

3. A baby bottle cleaner as set forth in claim 2 wherein the drive mechanism includes a plurality of belts with engage each of the bottle cleaning assemblies for rotating the same.

4. A baby bottle cleaner as set forth in claim 2 wherein a water conduit is connected to the bottle cleaning assemblies along with a secondary conduit for feeding detergent into the water conduit.

* * * * *